US005191826A

United States Patent [19]

Brunner

[11] Patent Number: 5,191,826

[45] Date of Patent: Mar. 9, 1993

[54] HYDRAULIC CONTROL DEVICE

[75] Inventor: Rudolf Brunner, Baldham, Fed. Rep. of Germany

[73] Assignee: Heilmeier & Weinlein Fabrik Fur Oel-Hydraulik, Fed. Rep. of Germany

[21] Appl. No.: 691,239

[22] Filed: Apr. 25, 1991

[30] Foreign Application Priority Data

Jul. 5, 1990 [DE] Fed. Rep. of Germany ..... 4021347
Feb. 7, 1991 [EP] European Pat. Off. ..... 91101694

[51] Int. Cl.[5] ..... F15B 11/08

[52] U.S. Cl. ..... 91/418; 91/420; 91/463; 60/460; 60/461; 60/466; 60/469

[58] Field of Search ..... 91/418, 420, 461, 463; 60/460, 461, 466, 469

[56] References Cited

U.S. PATENT DOCUMENTS 4,732,076 3/1988 Ewald ..... 91/420
4,969,562 11/1990 Saotome ..... 60/467 X
5,034,892 7/1991 Saotome ..... 60/469 X

FOREIGN PATENT DOCUMENTS 0063025 10/1982 European Pat. Off. ..... 91/461
1256383 12/1967 Fed. Rep. of Germany ..... 91/420
2036547 1/1972 Fed. Rep. of Germany ..... 91/420
3237103 4/1984 Fed. Rep. of Germany ..... 91/420
0014604 2/1981 Japan ..... 91/420

*Primary Examiner*—Edward K. Look
*Assistant Examiner*—Todd Mattingly
*Attorney, Agent, or Firm*—Kinzer, Plyer, Dorn, McEachran & Jambor

[57] ABSTRACT

In the case of a hydraulic control device for an oscillating load moving system comprising a double-acting hydroconsumer (V), which is adapted to be selectively connected to a pressure source (P) or to a reservoir (T) via two separate main lines (9, 10) and a control valve (C), and further comprising a load supporting valve (H), which is arranged in at least one main line (10) between the control valve (C) and the hydroconsumer (V) and which is adapted to be opened from the other main line (9) via a pilot line (16), a damping device (X), which consists of a bypass line (23) and an interference throttle aperture (D2), is connected to the pilot line (16) of the load supporting valve (H). The pilot line (16) has provided therein a throttle aperture (D1) which is smaller than the interference throttle aperture (D2).

10 Claims, 4 Drawing Sheets

HYDRAULIC CONTROL DEVICE

BACKGROUND OF THE INVENTION

The present invention refers to a hydraulic control device for an oscillating load moving system.

FIELD OF THE INVENTION

An oscillating load moving system is, for example, a crane in the case of which oscillating movements, which are also due to large leverages, occur at the beginning or at the end of rapid load movements, said oscillating movements reacting on the hydroconsumer or the hydroconsumers and resulting in pressure fluctuations in the hydraulic system. The hydraulic columns of the theoretically incompressible medium show elastic reactions in practical operation so that, due to the combined effect of various factors, the oscillating movements and the pressure fluctuations are inconveniently maintained for a long period of time, i.e. also during the movement of the load.

RELATED ART

It is true that it is known (publication D 7100 of the firm of Heilmeier & Weinlein, June 1986, page 2) to suppress the the tendency to oscillate of a hydroconsumer in a hydraulic circuit, which contains at least one openable load supporting valve, by means of an adjustable motion damping throttle in in the pilot line of the load supporting valve, but the effect produced by said motion damping throttle alone does not suffice in many cases.

SUMMARY OF THE INVENTION

The present invention is based on the task of providing a hydraulic control device as disclosed with which effective damping of pressure fluctuations is achieved in a simple and economy-priced manner. In accordance with the present invention, the posed task is solved by arranging in the pilot line having a load supporting valve, a hydraulic damping device for damping pressure fluctuations, which device comprises a bypass line branching off the pilot line and provided with an interference throttle aperture, FIGS. 2, 3, 4 and 8.

For the purpose of damping the pressure fluctuations only the control pressure circuit of the load supporting valve is acted upon; nevertheless, the damping becomes rapidly effective up to and into the operating circuit and the hydroconsumer. The desired damping is achieved independently of the type of control valve used and independently of the structural design of said control valve, and this means that an arbitrary control valve can be chosen. It is also possible to use a complicated control valve with supply flow regulators and load pressure sensing, the use of such a control valve in the case of systems which tend to oscillate being, in principle, critical because it may generate pressure fluctuations. The damping effect is presumably based on the fact that, due to the amount of hydraulic medium discharged via the bypass line from the pilot line, the tops and the valleys occurring in the pressure curve in the case of pressure fluctuations are cut off, and the oscillating pressure behaviour in the main lines and in the hydroconsumer is interfered with in such a way that pressure oscillations will decay rapidly. The amount of hydraulic medium discharged from the pilot circuit for damping purposes is small.

To secure the lift cylinder in the case of fork lift trucks by means of a lowering brake is known, said lowering brake limiting the maximum lowering speed independently of the load. The main flow path of said lowering brake includes an unthrottled bypass passage, which smoothens the overall control characteristic with regard to a suppression of pressure fluctuations. This principle is, however, not adapted to be used for cranes equipped with double-acting hydroconsumers.

In the case of one embodiment, FIG. 2, the block including the load supporting valve remains the conventional one. It has been modified for the additional function with little expenditure from the point of view of production technology. A hydraulic control device which has already been in operation can be reset subsequently simply by exchanging the block.

Another embodiment shown in FIGS. 3–5 and 8, corresponds to the modern unit construction principle for selectively combinable components. The structural unit can easily be incorporated into the pilot circuit at the appropriate location. In the case of a hitherto undamped system, a damping possibility is subsequently provided by attaching the structural unit. If desired, the structural unit is incorporated into the main circuit; in this case, the bypass line and the interference throttle aperture are increased in size.

By establishing cooperation between the throttle aperture and the interference throttle aperture, through which the interference volume is discharged from the pilot line, this results in the rapidly effective damping of pressure fluctuations shown in FIGS. 2–5 and 8.

Although it must be expected that the opening of the load supporting valve will be impaired, when the size of the interference throttle aperture exceeds that of the throttle aperture, it turns out, surprisingly enough, that in this case, FIG. 2 an unexpected damping effect is achieved and the load supporting valve operates undisturbed.

The hole used as throttle aperture has e.g. a diameter of 0.8 mm and the hole used as interference throttle aperture has e.g. a diameter of 1.0 mm. The ratios and the sizes of the apertures are always adapted to the respective demands in each individual case.

In the case of the above-mentioned embodiments, the bypass line branches off the pilot line. It is, however, also possible to arrange the bypass line in the cylinder, which contains the control piston of the load supporting valve, or in the control piston itself, and to connect it to the cylinder member at the back of the control piston, said cylinder member being vented anyhow.

The motion damping throttle is adjusted to pressure medium having the operating temperature or it is, also for other reasons, adjusted so tightly that it would delay rapid closing of the load supporting valve, when the pressure medium is cold or in response to an abrupt stopping command. This would result in after-running of the hydroconsumer under the load. The check valve in the parallel line eliminates this risk (FIG. 8) because this check valve causes rapid flowing off of the pressure medium past the motion damping throttle for the purpose of closing the load supporting valve, when the pressure in said one main line and in the pilot line falls below the pressure opposed to the closing movement of the load supporting valve. In the case of lowering with pressure in said one main line, the check valve is kept closed. If pressure fluctuations occur while the load is being lowered, the pressure medium will be moved through the motion damping throttle; an extreme pressure drop in said one main line will have the effect that the check valve is opened for a short time, said check valve contributing thus to the damping effect. No after-running will occur when the pressure medium is cold or when the motion damping throttle is adjusted tightly.

In the case of the embodiment shown in FIGS. 2-5 and 8, the damping device and the motion damping throttle cooperate such that the best possible damping effect is achieved.

The closing movement of the control piston is not impaired by the check valve shown in FIG. 3 because the pressure medium flows off via the bypass line.

Pressure medium flowing off through the bypass line and the interference throttle aperture shown in FIGS. 4 and 8 will flow into the main line including the load supporting valve. A connection between the bypass line and the reservoir can be dispensed with. The check valve provided in the bypass line guarantees that, when pressure is applied to the other main line, a flow of pressure medium through the bypass line to said one main line will not take place.

According to FIGS. 3, 4 and 8, the main lines are not used for discharging the pressure medium which flows off for the purpose of damping the pressure fluctuations.

The pressure reservoir according to FIG. 4 contributes to a rapid decay of the pressure fluctuations.

An additional expedient embodiment is the case of which the load supporting valve has provided therein a closure member, which is pressed by the force of a spring in the closing direction onto a valve seat located in the main line, and a control piston, which is acted upon by the pressure in the pilot line and which applies a load to the closure member in the opening direction, FIG. 6. Normally, a geometrical area ratio of 1:3 between the valve seat and the control piston is used in the case of hydraulic control devices for oscillating load moving systems throughout the world. Especially in the case of double-acting differential hydraulic cylinders this proved to be useful. By deviating from this area ratio, which has become generally accepted as a standard, the pressure difference resulting from the pressure medium which flows off through the bypass line is compensated and the advantage is achieved that, for the purpose of achieving effective damping and also for the purpose of opening, a larger amount of pressure medium is moved for applying to the control piston the same force as has hitherto been the case.

The present disclosure also imparts to the person skilled in the art an easily understandable teaching of area and diameter ratios (FIGS. 6 and 7) indicating how to obtain the best possible damping of the pressure fluctuations without causing any change in the control behaviour of the hydraulic control device.

In yet another embodiment, FIG. 5, both main lines of the hydroconsumer are secured by means of a load supporting valve. Effective damping of pressure fluctuations is achieved independently of the direction of movement of the load. The provision of interconnected bypass lines makes the arrangement more simple from the structural point of view.

PREFERRED EMBODIMENTS

Figure 1:
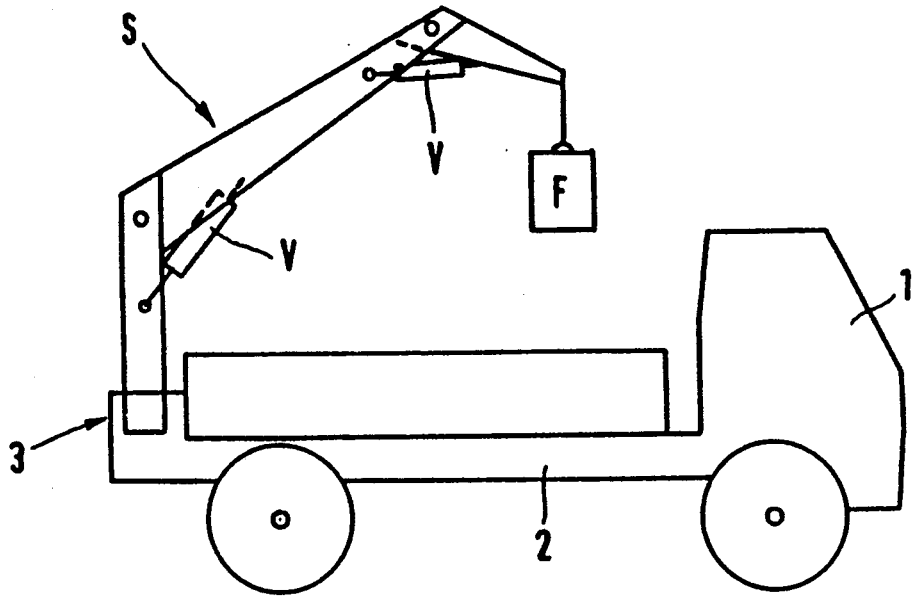
FIG. 1 shows a schematic view of an oscillating load moving system.

An oscillating load moving system S according to FIG. 1 is e.g. a hydraulic crane 3, which is mounted on a truck 1 on the vehicle frame 2 thereof and the boom components of which are moved by hydroconsumers V, e.g. double-acting hydraulic cylinders, when a load F is to be manipulated. At the beginning or at the end or also during the movement of the load F, forces will occur, which, especially in view of the large leverages, will cause the boom components to oscillate, whereby perceptible pressure fluctuations will be generated in the hydroconsumers V and this will, in turn, result in dangerous or unpleasant load movements.

Figure 2:
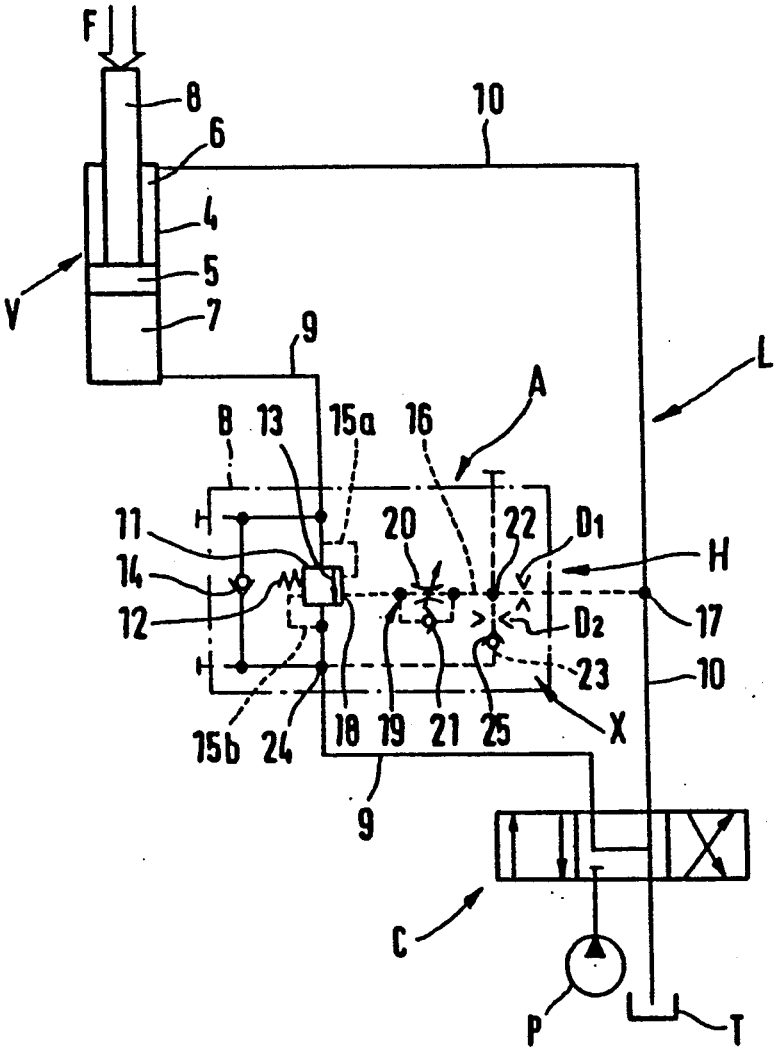
FIG. 2 shows a hydraulic control device as a block diagram.

FIG. 2 shows, in a block diagram, a hydraulic control device L by means of which e.g. the left hydroconsumer V is actuated, said left hydroconsumer V being shown in FIG. 1. The hydraulic control device L comprises a load supporting valve H including a pilot circuit A and a damping device X as well as a schematically indicated control valve C, and it is supplied with pressure medium from a pressure source P having associated therewith a reservoir T.

The hydroconsumer V is a double-acting differential cylinder 4 provided with a piston 5, which is acted upon by the load F via a piston 8. The chambers 6 and 7 of the cylinder 4 are connected to control valve C via main lines 9, 10, and they are adapted to be alternatively connected to the pressure source P or the reservoir T so as to move the piston 5 in both directions. For the purpose of stopping the load, the control valve is provided with a zero position. The load supporting valve H is arranged in the other main line 9, and, for the purpose of lowering the load F, it has applied thereto an opening pressure from said one main line 10, said opening pilot pressure being adjusted by control valve C.

The load supporting valve H includes a valve 11 provided with a closure member 13, which has a load applied thereto in the closing direction by a spring 12 and by a pilot pressure within a pilot line 15*b* branching off the part of the other main line 9 which faces the control valve C. A check valve 14, which blocks in the direction towards control valve C when seen in the direction of flow, bypasses the valve 11. In the opening direction, the closure member 13 is acted upon by the pilot pressure of a pilot line 15*a* against the force of the spring 12, said pilot line 15*a* being outlined in the drawing and branching off the part of the other main line 9 which faces the hydroconsumer V.

The pilot circuit A is provided with a pilot line 16 branching off a branch 17 of said one main line 10 and leading to a connection 18 of the valve 11. For the purpose of damping the motions of the closure member 13 and of the control piston, which is used for moving the the closure member into its open position and which is associated therewith (cf. FIG. 5), the pilot line 16 can include therein a component 19 comprising a motion damping throttle 20, which is preferably adjustable, and a bypass check valve 21, which blocks in the direction of said one main line 10. If said bypass check valve 21 is not provided, the closing as well as the opening movements of the closure member 13 will be damped.

A bypass line 23 branches off a branch 22 of the pilot line 16, said bypass line 23 including an interference throttle D2. In the case of the present embodiment, the bypass line 23 leads to a junction point 24 located in the part of the other main line 9 which faces the control valve C. Between the branches 17 and 22 in the pilot line 16, a throttle aperture D1 is provided, which is smaller than the interference throttle aperture D2 (e.g. throttle aperture D1 0.8 mm, interference throttle aperture D2 1.0 mm). A check valve 25, which blocks in the direction towards the interference throttle aperture D2, can be provided between the interference throttle aperture D2 and the junction point 24.

In the position shown in FIG. 2, the valve 11 holds the load. The check valve 14 blocks. The part of the main line 9 located between the load supporting valve H and the control valve C is vented to the reservoir T.

For lifting the load F, the control valve C is shifted so that the main line 9 is connected to the pressure source P and the main line 10 is connected to the reservoir T. Closure member 13 remains in its closed position. The check valve 14 opens. The chamber 7 has pressure applied thereto. The piston 5 is extended. Pressure medium is discharged from chamber 6 through the main line 10.

For stopping the load F, the control valve C is returned to its former position; the condition according to FIG. 2 is reestablished.

For lowering the load F, the chamber 6 and the pilot line 16 have pressure applied thereto, said pressure opening the closure member 13 against the force of the spring 12. The load F begins to sink. Pressure medium flows continuously to the other main line 9, which communicates with the reservoir T, via the bypass line 23. If pressure fluctuations occur in the chambers 6 and 7, in the main lines 9, 10 and in the pilot circuit of the load supporting valve H, said pressure fluctuations will be damped due to the pressure medium flowing off through the bypass line 23 and the interference throttle aperture D2 and due to the motion damping throttle 20.

For stopping the load F, the one main line 10 is vented. The check valve 14 is in its blocking position. The closure member 13 is moved to its closed position, said movement being damped by the motion damping throttle 20. Pressure medium flows to said one main line 10 and/or is discharged through the bypass line 23 via the check valve 25.

Figure 3:
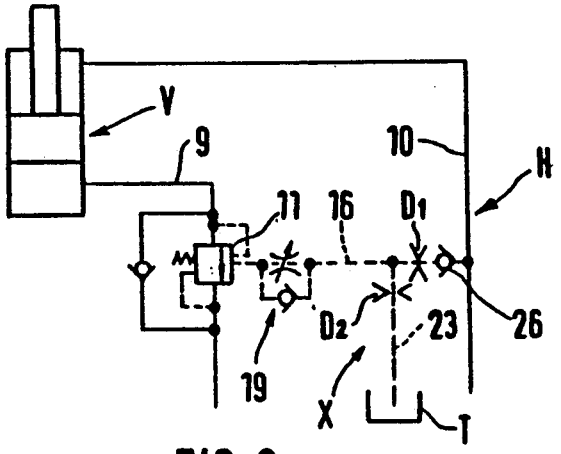
FIG. 3 shows a detail variant.

The hydraulic control device H according to FIG. 3 differs from that according to FIG. 2 with regard to the fact that the bypass line 23 directly communicates with the reservoir T. Furthermore, the pilot line 16 has provided therein a check valve 26 blocking in the direction towards the one main line 10. Also in the case of the embodiment according to FIG. 2, the check valve 26 can be arranged at the same location. The function of the control device corresponds to that of the control device shown in FIG. 2. The only difference is that pressure medium cannot flow back into said one main line 10.

Figure 4:
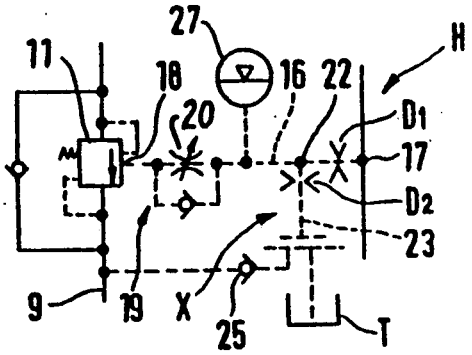
FIG. 4 shows another detail variant.

According to FIG. 4, the pilot line 16 has connected thereto a pressure reservoir 27, which will most expediently be located between the component 19 and the branch 22. The check valve 26 of FIG. 3 may be provided at the same location. Furthermore, it is outlined that the bypass line 23 leads either directly to the reservoir T or, as in the case of FIG. 2, to the second main line 9.

Figure 5:
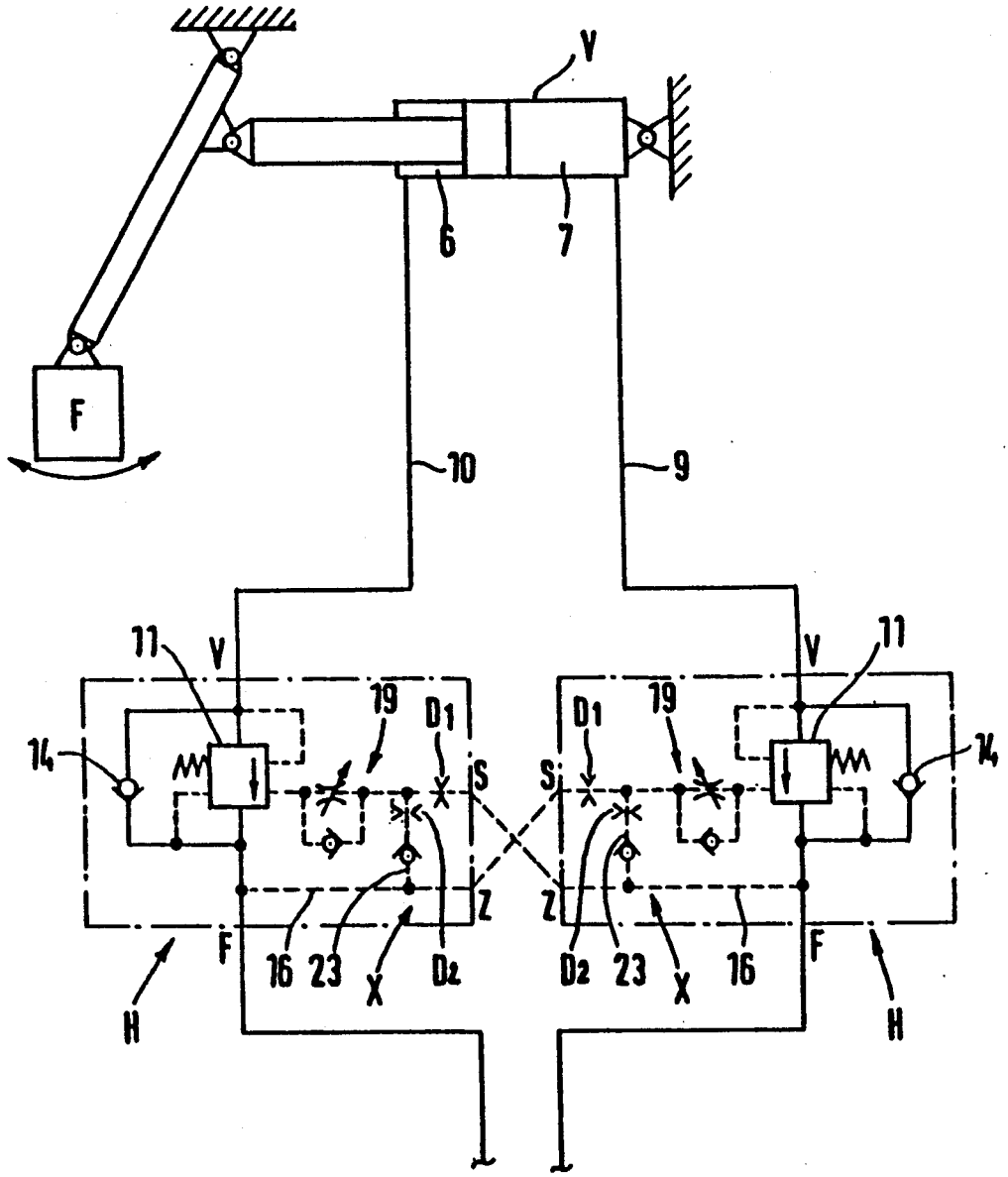
FIG. 5 shows still another detail variant.

In FIG. 5, the hydroconsumer V (e.g. the buckling cylinder in FIG. 1) is protected by load supporting valves H in both operating directions. The bypass lines 23 of both damping devices X are connected to the respective other pilot line 16.

Figure 6:
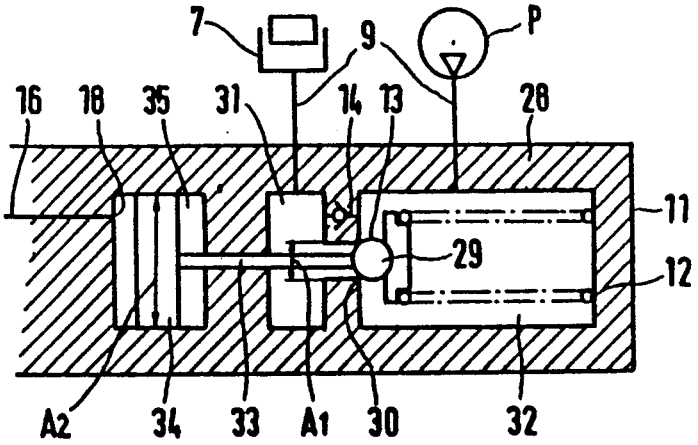
FIG. 6 shows a schematic section through a load supporting valve.

FIG. 6 shows a schematic representation of the valve 11 of the load supporting valve. The closure member 13, which is constructed as a ball 29, is pressed onto a valve seat 30 by the spring 12 within its housing 28, said valve seat 30 interconnecting two chambers 31 and 32. The chamber 31 has connected thereto the part of the other main line 9 leading to the chamber 7, whereas the chamber 32 has connected thereto the part of the main line 9 leading to the control valve C. The check valve 14 is positioned between the chambers 31 and 32. A control piston 34 is adapted to be acted upon by the pressure in the pilot line 16 so as to move the closure member 13 to its open position via a tappet 33. The chamber portion 35 positioned behind the control piston 34 is vented. The valve seat 30 has a cross-sectional area A1, and this cross-sectional area A1 and the area A2 of the control piston 34 which is acted upon by pressure have a geometrical area ratio which is larger than 1:4 and preferably larger than 1:6.5. The pressure within chamber 32 acts on the closure member 13 parallel to the spring 12 in the closing direction. The pressure within chamber 31 acts on the closure member 13 parallel to the control piston 34 in the opening direction.

The bypass line 23 may also extend through the control piston 34 to the chamber 35 and it may contain the interference throttle aperture D2. It would, however, also be possible to arrange the bypass line 23 such that its outlet is located on the side of the opening piston 34 acted upon by pressure.

Figure 7:
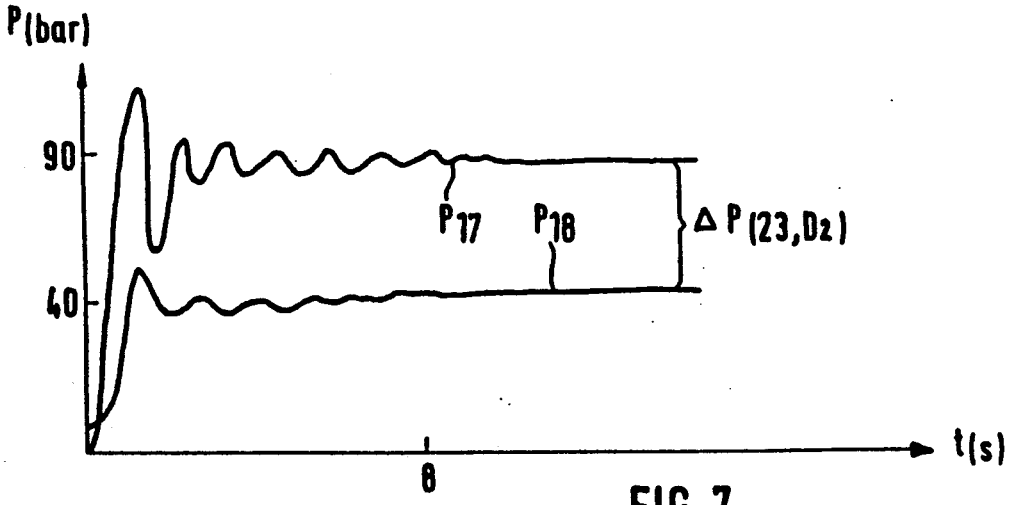
FIG. 7 shows a pressure/time diagram for illustrating the damping effect in the hydraulic control device.

FIG. 7 shows a diagram in which the vertical axis represents the pressure, whereas the horizontal axis represents the time. The curve P17 is representative of the pressure behaviour at the branch 17. The lower curve P18 is representative of the pressure behaviour at the connection 18. Both pressures fluctuate strongly at the beginning and calm down afterwards and, finally, they remain constant. Due to the pressure medium flowing off via the bypass line 23 and the interference throttle aperture D2, a pressure difference dP exists between the pressures P17 and P18. This pressure difference is compensated by the size of the area of the control piston 34 (FIG. 5) which is acted upon by pressure so that the load supporting valve H works in the usual way.

In the case of one concrete embodiment, the throttle aperture D1 has a diameter of 0.8 mm, the interference throttle aperture D2 has a diameter of 1.0 mm, and the control piston 34 has a diameter of 17 mm. The pressure at the branch 17 is approx. 90 bar, whereas the pressure P18 at the connection 18 is approx. 40 bar. A pressure difference of approx. 40 bar is eliminated via the bypass line 23 and the interference throttle aperture D2.

Figure 8:
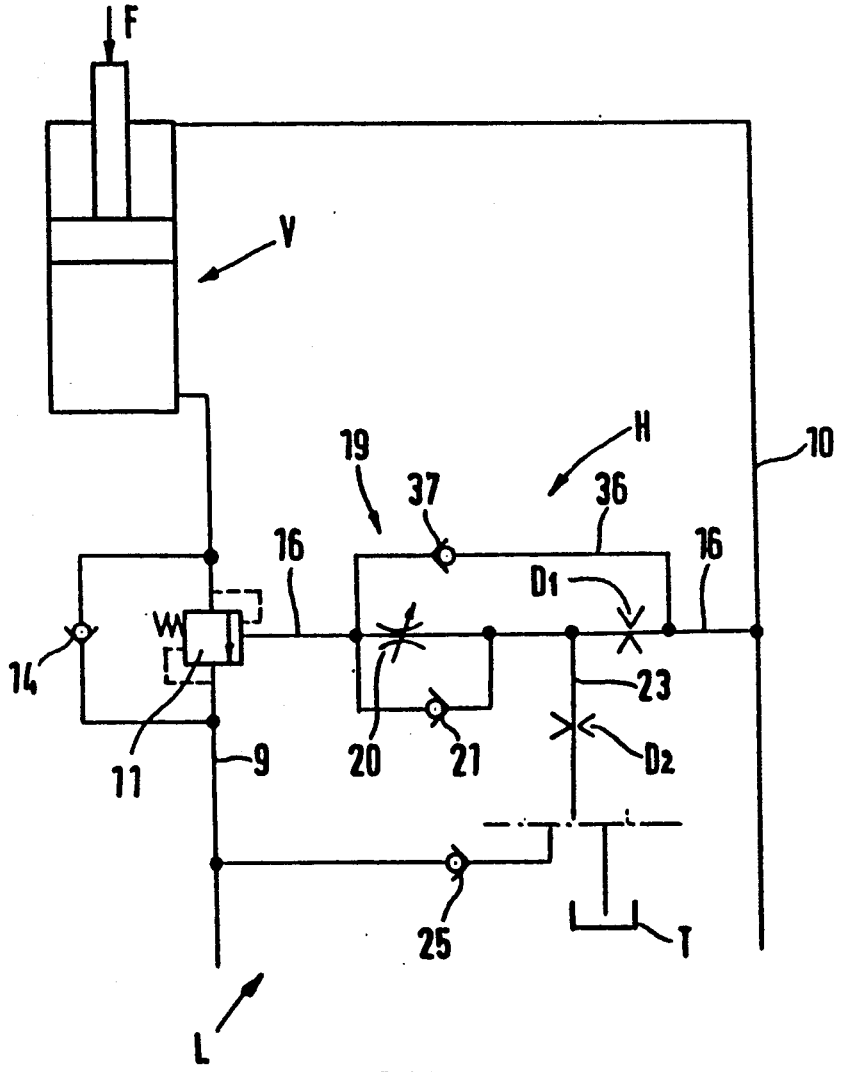
FIG. 8 shows a block diagram of an additional embodiment.

In the case of the hydraulic control device L according to FIG. 8, a parallel line 36 is provided in addition to the embodiment of FIG. 2 or 3, said parallel line 36 branching off the pilot line 16 between the component 19 and the valve 11 and ending into the pilot line 16 between the throttle aperture D1 and the branch 17. It bypasses the motion damping throttle 20 and contains a check valve 37 opening in the direction of said one main line 10. The parallel line 36 can also be directly connected to said one main line 10. In the case of a cold pressure medium or in the case of a tightly adjusted damping throttle, the check valve 37 has the effect that pressure medium flows off past the throttle 20 for rapidly closing the valve 11. Moreover, said check valve 37 contributes to the damping effect because it permits pressure peaks to pass. The bypass line 23 may be connected to the other main line 9 or immediately to the reservoir T. In the case of pressure fluctuations in the system, the pressure existing at the throttle aperture D1 keeps the check valve 37 closed so that the motion damping throttle 20 becomes effective in the manner intended.

The damping device X with or without the check valve 37 is particularly expedient for use in control devices in load moving systems which are subject to oscillations and in which comparatively complicated control valves with supply flow regulators and with load pressure sensing are provided, said control valves operating, on the one hand, uninfluenced by pressure variations on the pump side and in a load-independent manner, but, on the other hand, they themselves show a tendency to generate or to maintain pressure fluctuations within the system. By means of the embodiment according to the present invention, the pressure fluctuations in the system are damped effectively and rapidly, independently of their point of origin.

I claim:

1. A hydraulic control device for an oscillating load moving system, comprising a double-acting hydroconsumer (V), which is adapted to be selectively connected to a pressure source (P) or to a reservoir (T) via two separate main lines (9, 10) and a control valve (C), and further comprising a load supporting valve (H), which is arranged in at least one of the main lines (9, 10) between the control valve (C) and the hydroconsumer (V) and adapted to be opened from another one of the main lines (9, 10) via a pilot line (16), characterized in that the pilot line (16) of the load supporting valve (H) has arranged therein a hydraulic damping device (X) for damping pressure fluctuations, which consists of a bypass line (23) branching off the pilot line (16) and provided with an interference throttle aperture (D2), and further characterized in that a throttle aperture (D1) is provided in the pilot line (16) between a branching point (22) of the bypass line (23) and main line (10).

2. A hydraulic control device according to claim 1, characterized in that the damping device (X) is incorporated into a block (B) containing the load supporting valve (H).

3. A hydraulic control device according to claim 1, characterized in that the damping device (X) is an independent structural unit connected to the pilot line (16) of the load supporting valve (H).

4. A hydraulic control device according to claim 1, characterized in that the interference throttle aperture (D2) is larger than said throttle aperture (D1).

5. A hydraulic control device according to claim 4, characterized in that the diameter ratio of the throttle apertures (D1, D2) is substantially 1:1.25.

6. A hydraulic control device according to claim 1, characterized in that a motion dampening throttle (20) is provided in the pilot line (16) and that a pressure reservoir (27) is connected to pilot line (16) between the motion dampening throttle and the branching point (22).

7. A hydraulic control device for an oscillating load moving system, comprising a double-acting hydroconsumer (V), which is adapted to be selectively connected to a pressure source (P) or to a reservoir (T) via two separate main lines (9, 10) and a control valve (C), and further comprising a load supporting valve (H), which is arranged in at least one of the main lines (9, 10) between the control valve (C) and the hydroconsumer (V) and adapted to be opened from another one of the main lines (9, 10) via a pilot line (16), characterized in that the pilot line (16) of the load supporting valve (H) has arranged therein a hydraulic damping device (X) for damping pressure fluctuations, which consists of a bypass line (23) branching off the pilot line (16) and provided with an interference throttle aperture (D2), further characterized in that the pilot line (16) has provided therein a throttle aperture (D1), a motion damping throttle (20) and a bypass check valve (21) for said motion damping throttle (20), said bypass check valve (21) opening in the opening direction of the load supporting valve (H), and further characterized in that a check valve (37), which opens in the direction towards main line (10) is arranged in a parallel line (36) bypassing the motion damping throttle, and that the parallel line (36) is connected to the pilot line (16) between the throttle aperture (D1) and said main line (10), or is directly connected to said main line (10).

8. A hydraulic control device for an oscillating load moving system, comprising a double-acting hydroconsumer (V), which is adapted to be selectively connected to a pressure source (P) or to a reservoir (T) via two separate main lines (9, 10) and a control valve (C), and further comprising a load supporting valve (H), which is arranged in at least one of the main lines (9,10) between the control valve (C) and the hydroconsumer (V) and adapted to be opened from another one of the main lines (9,10) via a pilot line (16) which contains a throttle aperture (D1), characterized in that the pilot line (16) of the load supporting valve (H) has arranged therein a hydraulic damping device (X) for damping pressure fluctuations, which consists of a bypass line (23) branching off the pilot line (16) and provided with an interference throttle aperture (D2), the load supporting valve (H) having provided therein a closure member (13) which is pressed by the force of a spring in the closing direction onto a valve seat (30) located within main line (9), and a control piston (34) which is acted upon by the pressure in the pilot line (16) and which applies a load to the closure member in the opening direction, and further characterized in that the geometrical area ratio (A1:A2) between the valve seat (30) and the area of the control piston (34) which is acted upon by pressure is larger than 1:4.

9. A hydraulic control device according to claim 8, characterized in that the geometrical area ratio (A1:A2) of the control piston (34) and of the valve seat (30) and the diameter ratio of the throttle apertures (D1, D2) are adapted to one another in such a way that rapid damping of pressure fluctuations in the hydroconsumer (V) is achieved for a selectable ratio between the opening pressure (P18) at the control piston (34) and the pressure in the main line (10) providing the opening pressure (P17).

10. A hydraulic control device according to claim 9, characterized in that both main lines (9, 10) of the hydroconsumer (V) contain a load supporting valve (H), each of said load supporting valves (H) being provided with a damping device (X), and that the bypass lines (23) are interconnected.

* * * * *